US007255235B1

(12) United States Patent
Vry et al.

(10) Patent No.: US 7,255,235 B1
(45) Date of Patent: Aug. 14, 2007

(54) SADDLE HANGING SYSTEM

(76) Inventors: Walter L. Vry, 30912 139th Ave., Menagha, MN (US) 56464; David G. Wuollet, 46581 565th Ave., New York Mills, MN (US) 56567

( * ) Notice: Subject to any disclaimer, the term of this patent is extended or adjusted under 35 U.S.C. 154(b) by 0 days.

(21) Appl. No.: 11/247,017

(22) Filed: Oct. 10, 2005

(51) Int. Cl.
*A47F 7/00* (2006.01)

(52) U.S. Cl. ..... 211/85.11

(58) Field of Classification Search ..... 211/85.11; D30/135

See application file for complete search history.

(56) References Cited

U.S. PATENT DOCUMENTS

| | | | | |
|---|---|---|---|---|
| 2,740,532 A | | 4/1956 | Kleinsmith | 211/104 |
| 2,760,746 A | * | 8/1956 | Botolfsen | 248/222.51 |
| 3,233,745 A | | 2/1966 | Hershberger | 211/104 |
| 3,305,101 A | | 2/1967 | Mills | 211/87 |
| 3,476,255 A | * | 11/1969 | Ciancio | 211/85.11 |
| 3,780,971 A | | 12/1973 | De Filipps | 248/309 |
| 4,356,922 A | | 11/1982 | Dierksheide | 211/13 |
| 4,432,459 A | | 2/1984 | Coldren | 211/13 |
| 4,541,535 A | * | 9/1985 | Bartholomew | 211/96 |
| D294,753 S | * | 3/1988 | Otterbein | D30/143 |
| 4,768,656 A | | 9/1988 | Hartley | 211/13 |
| 4,958,594 A | | 9/1990 | Swagerty | 119/7 |
| 5,050,744 A | * | 9/1991 | Floyd | 211/85.11 |
| 5,590,795 A | | 1/1997 | Wright | 211/104 |
| 5,615,783 A | | 4/1997 | Warnken | 211/118 |
| 6,189,706 B1 | | 2/2001 | Akins | 211/87.01 |
| 6,206,207 B1 | | 3/2001 | Kelley | 211/85.11 |
| 6,520,119 B1 | | 2/2003 | Johnson | 119/705 |
| 6,659,476 B2 | | 12/2003 | Weida | 280/47.19 |
| 6,766,913 B2 | | 7/2004 | Steen et al. | 211/85.11 |

* cited by examiner

*Primary Examiner*—Richard E. Chilcot, Jr.
*Assistant Examiner*—Lindsay M. Maguire

(57) ABSTRACT

A saddle hanging system efficiently supporting a saddle in various locations. The saddle hanging system includes a support member comprised of a support plate having a catch member and first handle attached at a first end and a second handle attached at a second end. The support plate is a flattened V-shaped structure, formed to accept the placement of a saddle upon it. The catch member is U-shaped for positioning onto a fence or a connecting member. The handles located at each end are used for moving the support member from location to location or for adjusting when in place.

9 Claims, 8 Drawing Sheets

SADDLE HANGING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to saddle racks and more specifically it relates to a saddle hanging system efficiently supporting a saddle in various locations.

2. Description of the Related Art

Any discussion of the prior art throughout the specification should in no way be considered as an admission that such prior art is widely known or forms part of common general knowledge in the field.

Saddle racks have been in use for years. Typically, saddle racks attach to gates or doors leading into stalls or fenced in areas. The saddle racks attach to the top edge of the gate or door and are additionally supported by bars or rods extending to the main body of the gate or door. Unfortunately, saddle racks currently used today are not configured to attach to a plurality of objects (e.g. gates, fences, walls) as the user and horse move from location to location.

While these devices may be suitable for the particular purpose to which they address, they are not as suitable efficiently supporting a saddle in various locations. Current saddle racks are not capable of being easily attached to a plurality of items.

In these respects, the saddle hanging system according to the present invention substantially departs from the conventional concepts and designs of the prior art, and in so doing provides an apparatus primarily developed for the purpose of storing and/or drying a saddle on a portable rack capable of being attached to many objects.

BRIEF SUMMARY OF THE INVENTION

In view of the foregoing disadvantages inherent in the known types of saddle racks now present in the prior art, the present invention provides a new saddle hanging system construction wherein the same can be utilized efficiently supporting a saddle in various locations.

The general purpose of the present invention, which will be described subsequently in greater detail, is to provide a new saddle hanging system that has many of the advantages of the saddle racks mentioned heretofore and many novel features that result in a new saddle hanging system which is not anticipated, rendered obvious, suggested, or even implied by any of the prior art saddle racks, either alone or in any combination thereof.

To attain this, the present invention generally comprises a support member comprised of a support plate having a catch member and first handle attached at a first end and a second handle attached at a second end. The support plate is a flattened V-shaped structure, formed to accept the placement of a saddle upon it. The catch member is U-shaped for positioning onto a fence or a connecting member. The handles located at each end are used for moving the support member from location to location or for adjusting when in place.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a saddle hanging system that will overcome the shortcomings of the prior art devices.

A second object is to provide a saddle hanging system efficiently supporting a saddle in various locations.

Another object is to provide a saddle hanging system that conforms to the shape of a horse saddle.

An additional object is to provide a saddle hanging system that is lightweight.

A further object is to provide a saddle hanging system that is easily adjusted and transported.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
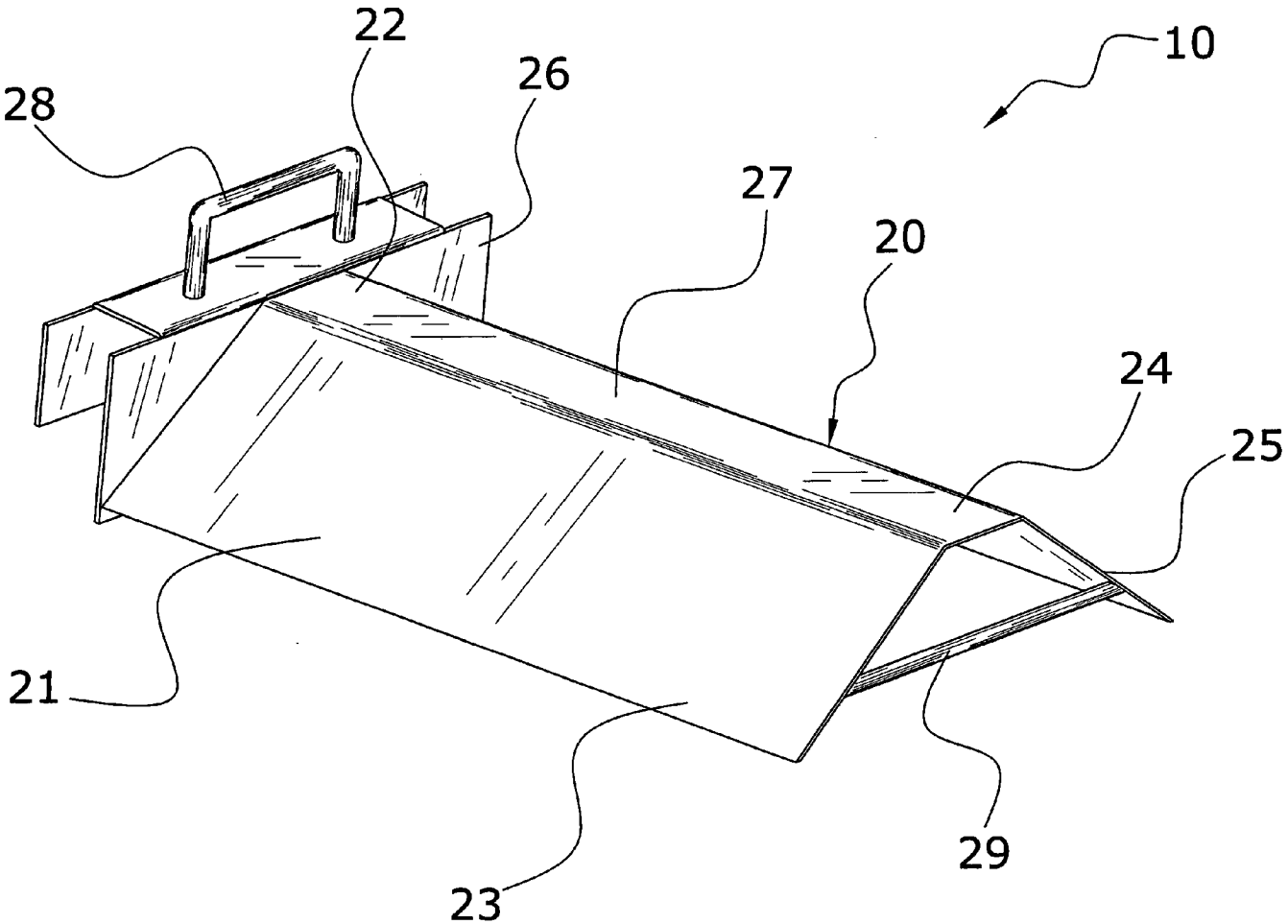
FIG. 1 is an upper perspective view of the present invention.
Figure 2:
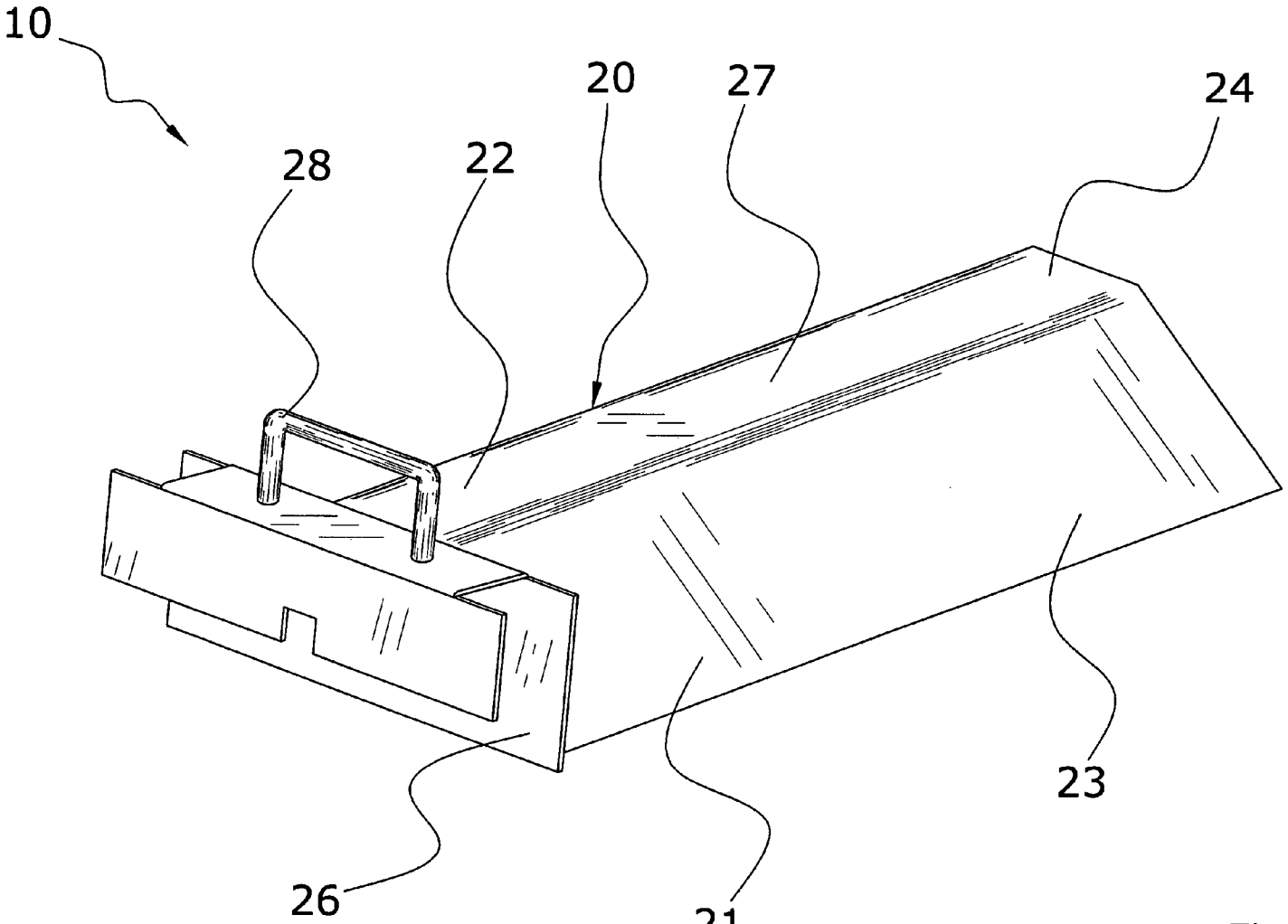
FIG. 2 is an upper perspective view of the present invention.
Figure 3A:
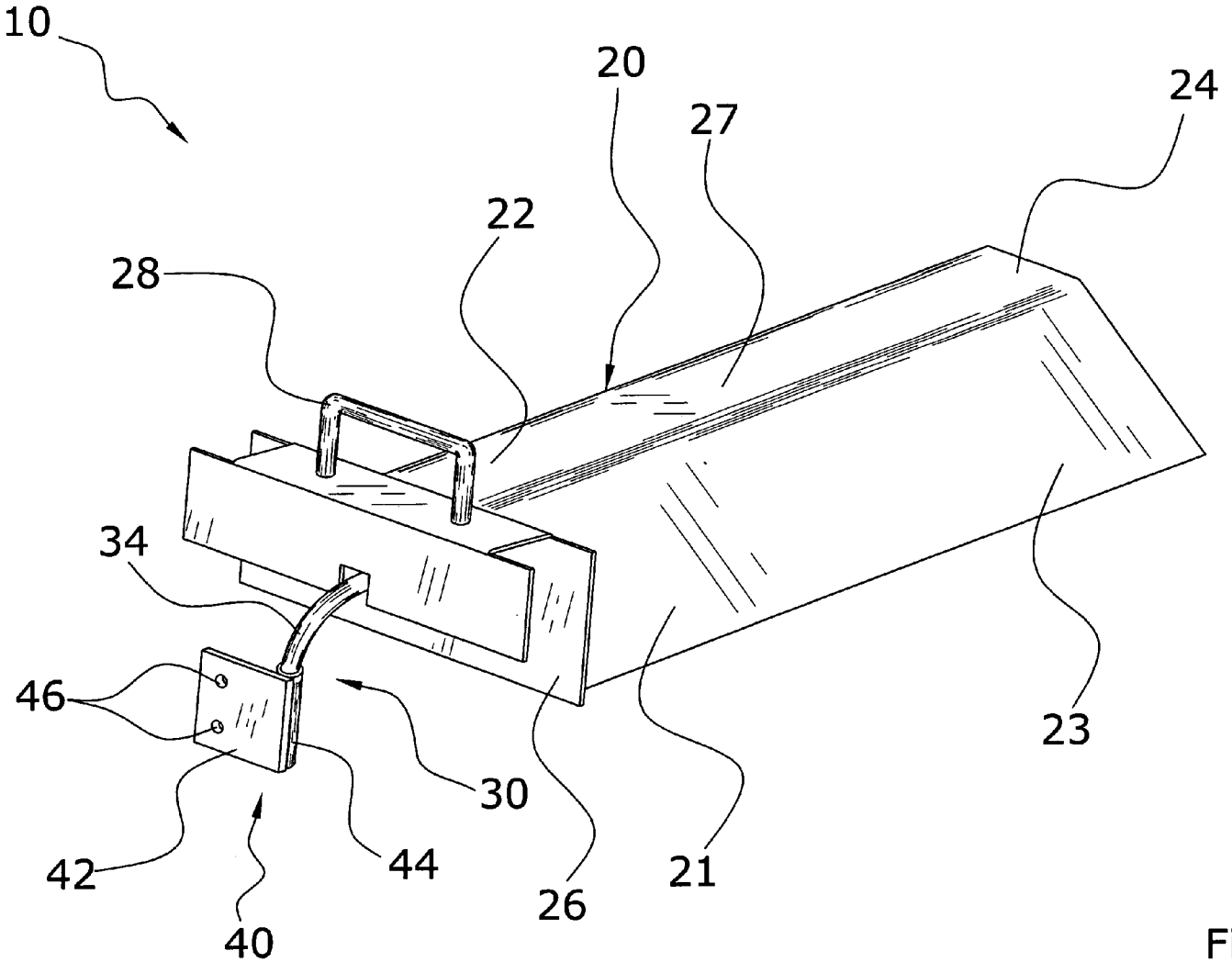
FIG. 3*a* is an upper perspective view of the present invention assembled to the connecting member and bracket member.
Figure 3B:
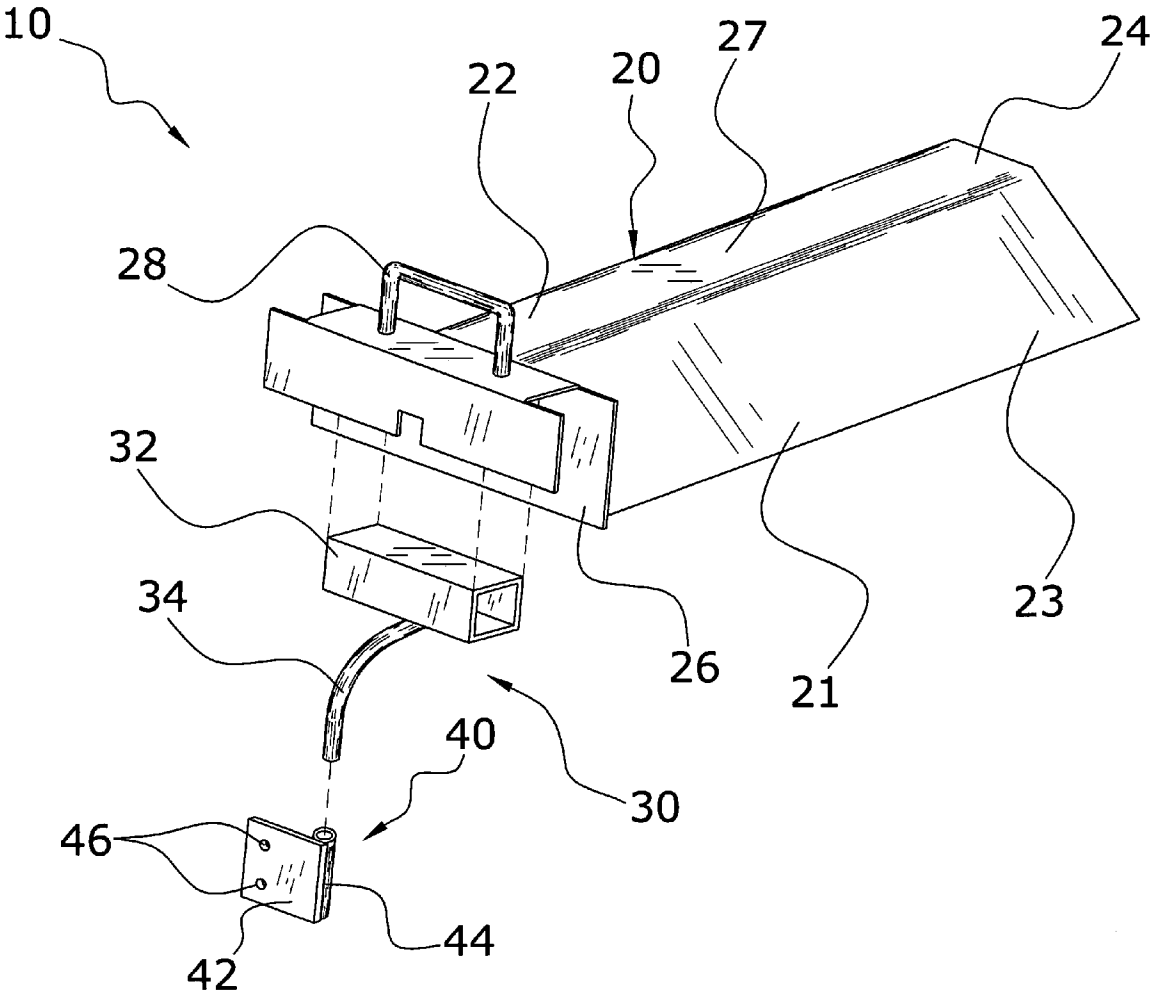
FIG. 3*b* is an exploded upper perspective view of the present invention, connecting member and bracket member.
Figure 4:
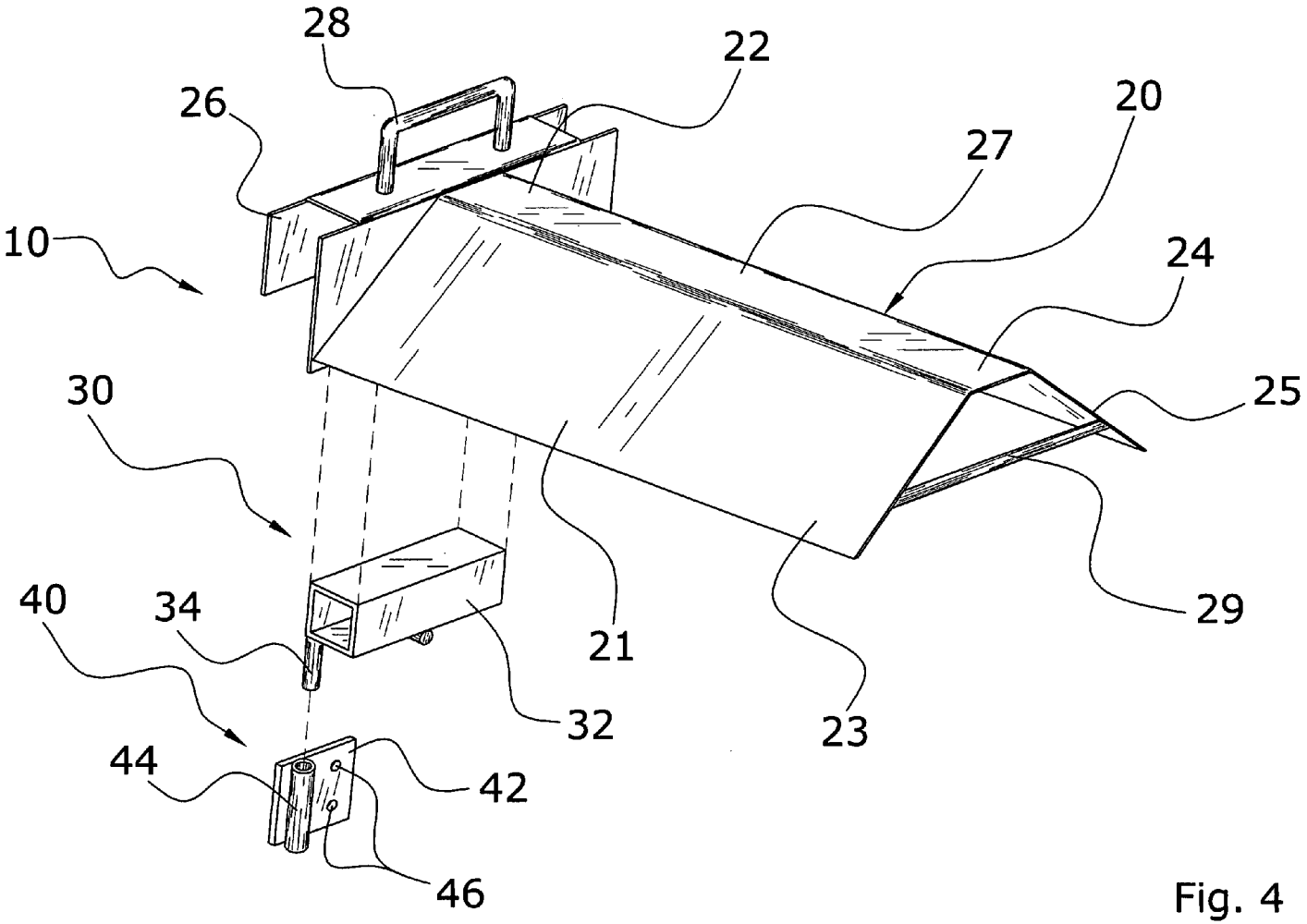
FIG. 4 is an exploded upper perspective view of the present invention, connecting member and bracket member.

Turning now descriptively to the drawings, in which similar reference characters denote similar elements throughout the several views, FIGS. 1 through 6*b* illustrate a saddle hanging system 10, which comprises a support member 20 comprised of a support plate 21 having a catch member 26 and first handle 28 attached at a first end 22 and a second handle 29 attached at a second end 24. The support plate 21 is a flattened V-shaped structure, formed to accept the placement of a saddle upon it. The catch member 26 is U-shaped for positioning onto a fence 12 or a connecting member 30. The handles 28, 29 located at each end 22, 24 are used for moving the support member 20 from location to location or for adjusting when in place.

B. Support Member

The support member 20 is preferably comprised of a support plate 21, a catch member 26, a first handle 28 and a second handle 29. The support member 20 components 21, 26, 28, 29 are preferably made of rigid materials that will not significantly distort when welded to or while supporting a saddle and associated items (e.g. blankets, straps) during in the normal usage of the saddle hanging system 10. The support member 20 components 21, 26, 28, 29 are preferably made of materials which will withstand periods of exposure to moisture such that they will not rust. The support member 20 components 21, 26, 28, 29 may additionally be coated with a finishing material which must adhere to the support member 20 components 21, 26, 28, 29 and withstand exposure to moisture. The support member 20 components 21, 26, 28, 29 preferably are metal (e.g. aluminum, titanium), however, are not restricted from being molded in a plastic or a composite material.

As illustrated in FIGS. 1 through 5 of the drawings, the support plate 21 is preferably formed into a substantially flattened V-shaped structure creating a first side 23, a second side 25 and an upper surface 27. However, it can be appreciated that other shapes (e.g. U-shaped) and manufacturing methods (e.g. molding) could be utilized for creating the support plate 21. The support plate 21 extends substantially straight from a first end 22 to a second end 24 a preferred length to support a saddle.

As shown in FIGS. 1 through 6*b*, attached substantially perpendicular to the first end 22 of the support plate 21 is a catch member 26. The catch member 26 is preferably formed into U-shaped structure having one extension longer than the other extension. The opening of the catch member 26 is sized to allow for the insertion of a fence 12 structure or other similar shaped structures (e.g. tube, board). The open end of the catch member 26 is orientated downward to permit the installation onto a fence 12 or similar structure.

The first handle 28 is preferably formed into a flattened U-shaped structure, however it can be appreciated that other shapes could be utilized to perform the function of a handle. As shown in FIGS. 1 through 6*b* of the drawings, the first handle 28 is preferably attached substantially perpendicular to an upper side of the catch member 26. The second handle 29 is preferably similarly sized to the first handle 28 and extends substantially straight at the second end 24 of the support plate 21 from the first side 23 to the second side 25, substantially parallel to the upper surface 27.

C. Connecting Member

The connecting member 30 is comprised of a mount tube 32 and a bar 34. The connecting member 30 components 32, 34 are preferably made of rigid materials that will not significantly distort when welded to or while supporting a saddle and associated items (e.g. blankets, straps) during in the normal usage of the saddle hanging system 10. The connecting member 30 components 32, 34 are preferably made of materials which will withstand periods of exposure to moisture such that they will not rust. The connecting member 30 components 32, 34 may additionally be coated with a finishing material which must adhere to the connecting member 30 components 32, 34 and withstand exposure to moisture. The connecting member 30 components 32, 34 preferably are metal (e.g. aluminum, steel), however, are not restricted from being molded in a composite material.

As shown in FIGS. 3*b*, 4, 6*a* and 6*b*, the mount tube 32 is preferably a substantially straight square tube structure, however is not restricted from being other shapes (e.g. rectangular). The mount tube 32 is sized to be securely inserted within the catch member 26 such that there is little side to side movement when installed within the catch member 26. The mount tube 32 length substantially matches that of the catch member 26.

As best illustrated in FIGS. 3*a*, 3*b*, 4, 6*a* and 6*b* of the drawings, the bar 34 is preferably formed in a 90 degree arching shape with straight extensions at both ends. One end of the bar 34 is attached adjacent to a bottom surface of the mount tube 32, preferably welded, but other methods of attachment (e.g. fasteners) could be utilized. The other end of the bar 34 extends freely downward from the mount tube 32 and is sized for insertion into a tube 44 on the bracket member 40.

D. Bracket Member

The bracket member 40 is comprised of a plate 42 and a tube 44. The bracket member 40 components 42, 44 are preferably made of rigid materials that will not significantly distort when welded to or while supporting a saddle and associated items (e.g. blankets, straps) during in the normal usage of the saddle hanging system 10. The bracket member 40 components 42, 44 are preferably made of materials which will withstand periods of exposure to moisture such that they will not rust. The bracket member 40 components 42, 44 may additionally be coated with a finishing material which must adhere to the bracket member 40 components 42, 44 and withstand exposure to moisture. The bracket member 40 components 42, 44 preferably are metal (e.g. aluminum, steel), however, are not restricted from being molded in a composite material.

As illustrated in FIGS. 3*a*, 3*b*, 4, 6*a* and 6*b* of the drawings, the plate 42 is a substantially flat and square structure. Extending through the plate 42 towards one edge of the plate is a plurality of apertures 46, preferably two as shown in the illustrations. The apertures 46 are sized for extending fasteners 16 through for fastening the bracket member 40 to a wall 14 or similar structure.

As shown in FIGS. 3*a*, 3*b*, 4, 6*a* and 6*b* of the drawings, the tube 44 is substantially straight, preferably extending a length similar to that of the plate 42. The tube 44 is attached to the plate, preferably welded adjacent to the plate 42 near the edge opposite the apertures 46 in alignment with the apertures 46. The tube 44 is sized for accepting the insertion of the bar 34 attached to the connecting member 30.

E. Operation of the Invention

In use, the saddle hanging system 10 is preferably used for storing and/or securing a saddle when not in use. When a saddle is placed upon the saddle hanging system 10 it allows the saddle to dry out perspiration from a horse if just used, helps maintain the shape of the saddle and keeps the saddle clean from dirt and the like.

Figure 5:
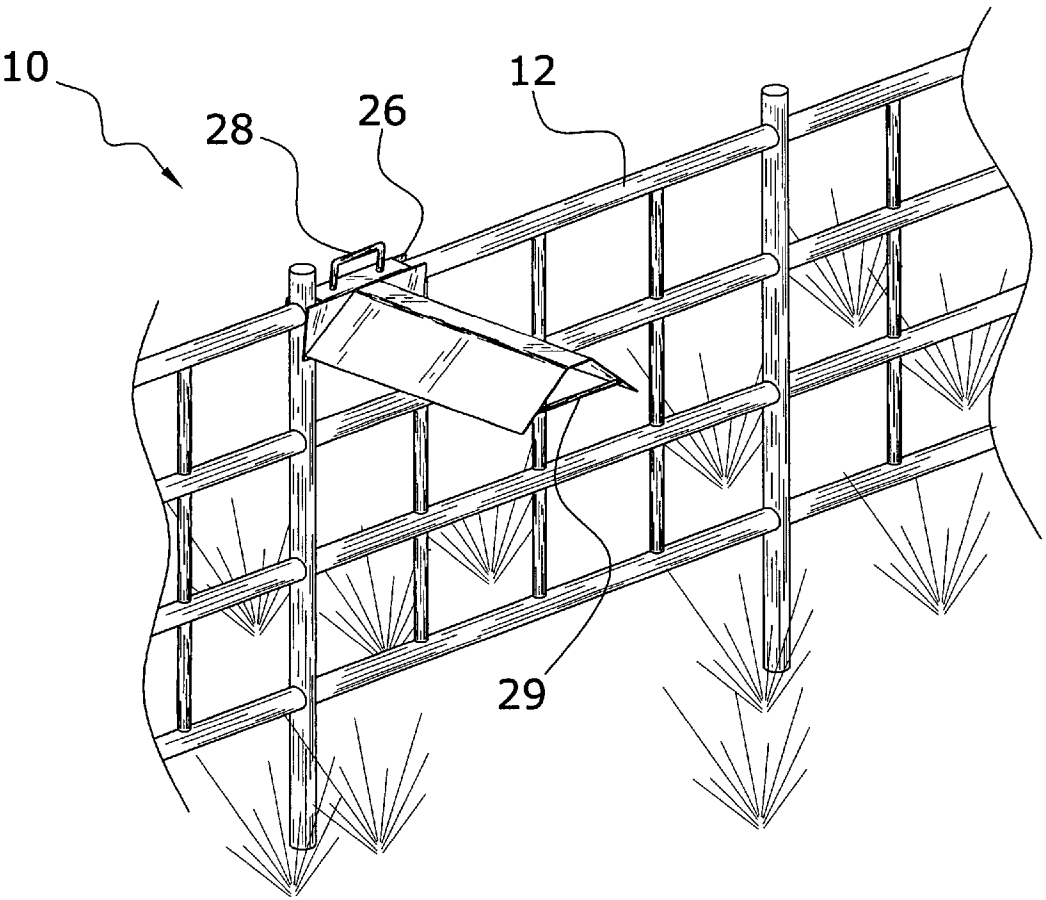
FIG. 5 is an upper perspective view of the present invention attached to a fence.

As best shown in FIG. 5 of the drawings, the support member 20 is simply placed over a cross member of a fence 12 or gate. The user preferably grasps at least the first handle 28 and positions the catch member 26 over the cross member of the fence 12 and secures it on the vertical members of the fence 12. This allows the user to place a saddle upon the support member 20 prior to riding or after riding the horse.

Figure 6A:
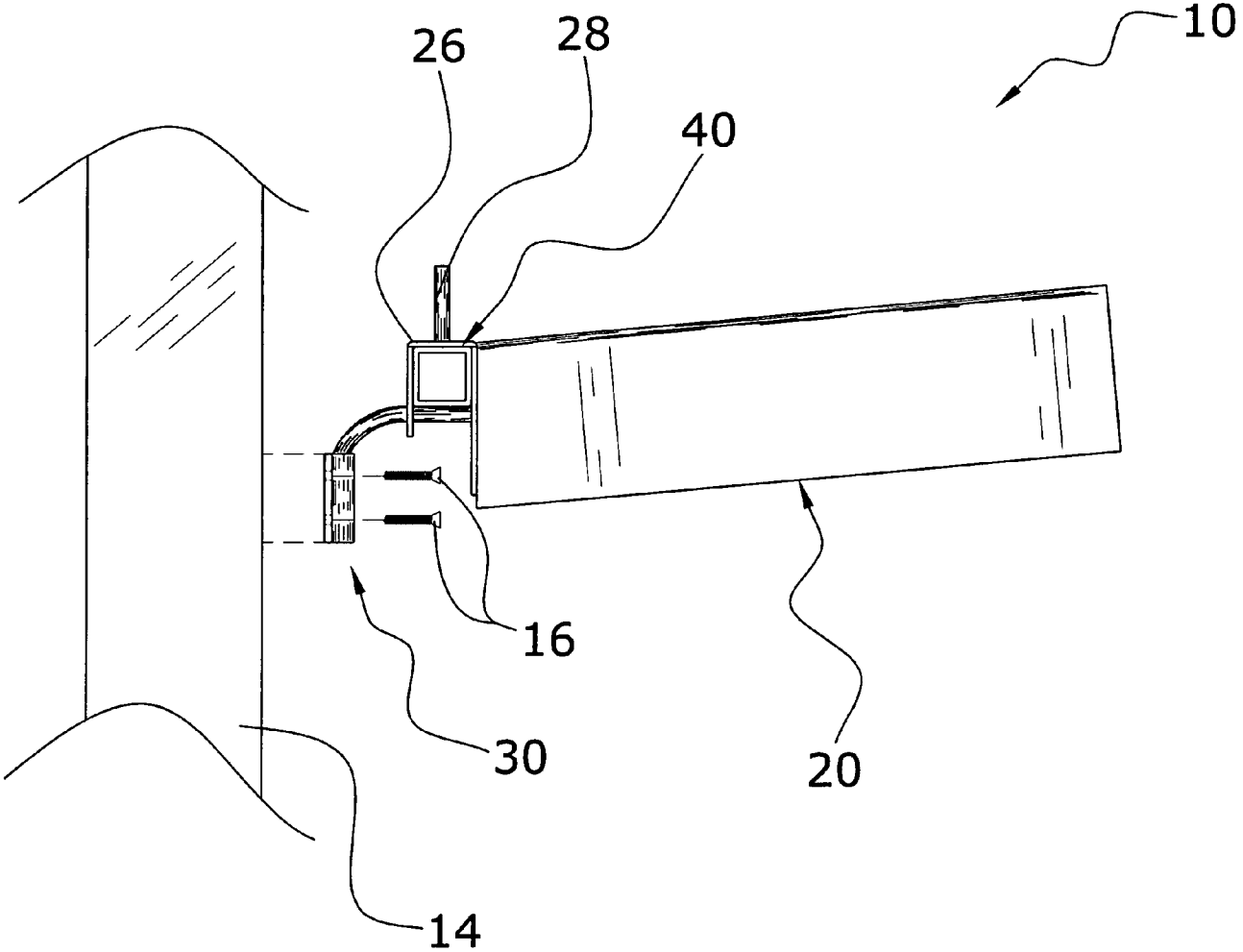
FIG. 6*a* is an exploded side view of the present invention fastening to a wall by means of the connecting member and bracket member.
Figure 6B:
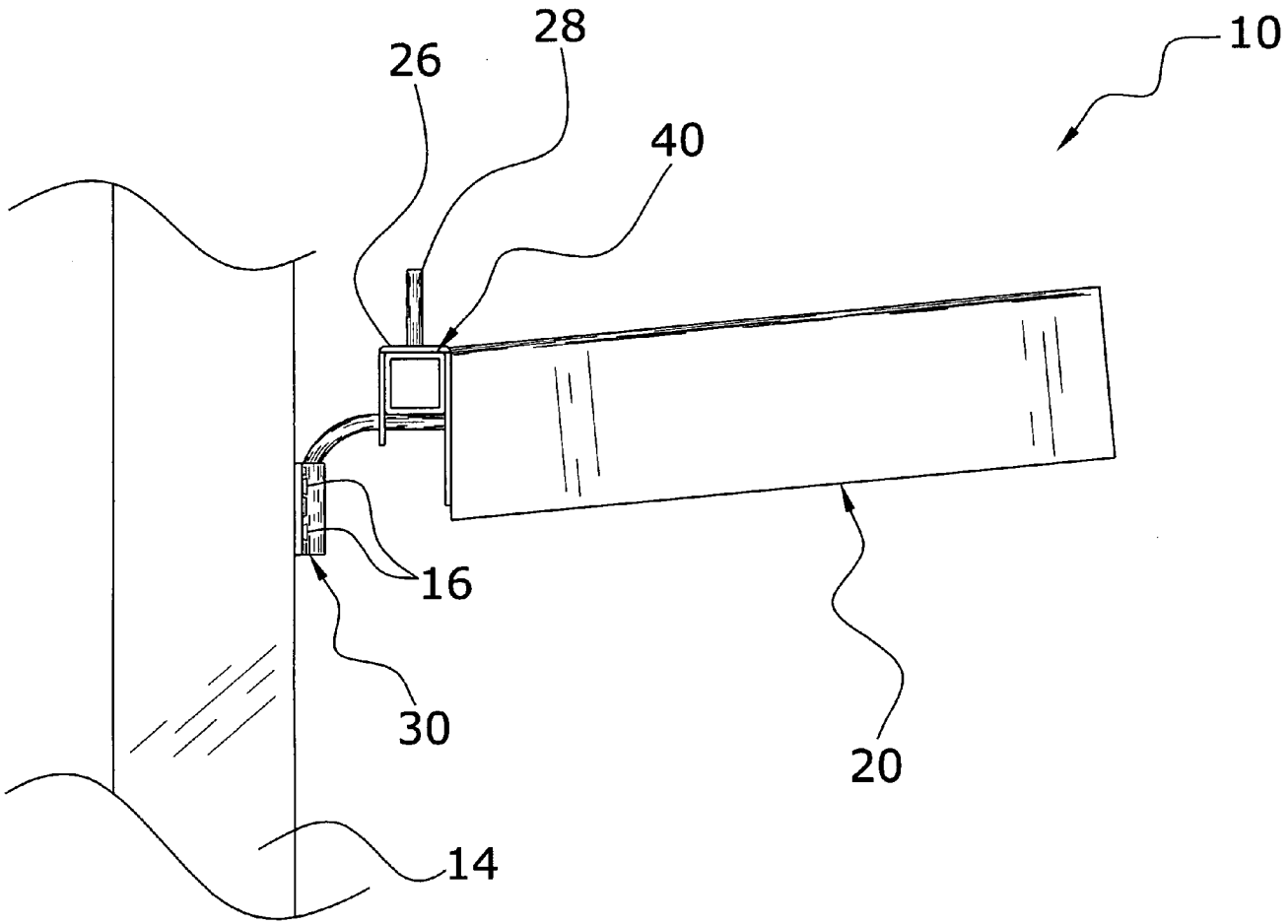
FIG. 6*b* is an exploded side view of the present invention fastened to a wall by means of the connecting member and bracket member.

As illustrated in FIGS. 3*a*, 3*b*, 4, 6*a* and 6*b*, the support member 20 can also be retained by the connecting member 30. In this embodiment, the bracket member 40 is fastened to a wall 14 of a barn, shelter, trailer or any other similar structures by means of fasteners 16 extending through the apertures 46 located in the plate 42 of the bracket member 40 as best shown in FIG. 6*a*. With the bracket member 40 properly attached, the bar 34 of the connecting member 30 is extended through the tube 44 on the bracket member 40 as shown in FIGS. 3*a*, 3*b*, 4, 6*a* and 6*b*. The user is then able to again preferably grasp at least the first handle 28 and position the catch member 26 over the mount tube 32 and secure the support member 20 to the connection member 30.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A saddle hanging system, comprising:

a support member having a first end and a second end, wherein said support member is formed for accepting a saddle placed upon it;

a catch member attached to said first end of said support member;

a first handle attached to said catch member;

wherein said catch member is substantially formed into a U-shaped structure having a first extension and a second extension forming a slot between thereof that is sized to allow for the insertion of a fence structure or board within, and wherein said first extension is longer than said second extension and wherein said first extension is positioned closer to said support member than said first extension; and a connecting member comprised of a mount tube and a bar, wherein said bar is attached to said mount tube and wherein said catch member is positioned over the mount tube to secure the support member to the connecting member.

2. The saddle hanging system of claim 1, wherein said support member is substantially formed into a flattened V-shape comprised of a first side, a second side and an upper surface.

3. The saddle hanging system of claim 2, including a second handle attached at said second end of said support member, wherein said second handle extends from said first side to said second side.

4. The saddle hanging system of claim 1, wherein said tube is sized to receive a bar extending through said tube.

5. A saddle hanging system, comprising:

a support member extending from a first end to a second end, wherein said support member is substantially formed into a flattened V-shape comprised of a first side, a second side and an upper surface for accepting a saddle placed upon it;

a catch member attached to said first end of said support member, wherein said catch member is substantially formed into a U-shaped structure;

a first handle attached to said catch member;

a second handle attached at said second end of said support member, wherein said second handle extends from said first side to said second side;

a connecting member comprised of a mount tube and a bar, wherein said catch member is positioned over the mount tube to secure the support member to the connecting member; and a bracket member comprised of a plate and a tube, wherein said tube is attached to said plate, wherein said plate includes a plurality of apertures, and wherein said tube is sized to receive said bar extending through said tube.

6. A saddle hanging system, comprising:

a support member having a first end to a second end, wherein said support member is capable of supporting a saddle;

a catch member attached said first end of said support member, wherein said catch member has a receiver channel capable of receiving a portion of a fence;

wherein said catch member is substantially formed into a U-shaped structure having a first extension and a second extension forming a slot between thereof that is sized to allow for the insertion of a fence structure or board within, and wherein said first extension is longer than said second extension and wherein said first extension is positioned closer to said support member than said first extension; and a connecting member comprised of a mount tube and a bar, wherein said bar is attached to said mount tube, wherein said plate includes a plurality of apertures used for extending fasteners through for mounting.

7. The saddle hanging system of claim 6, wherein said support member is substantially formed into a flattened V-shape comprised of a first side, a second side and an upper surface.

8. The saddle hanging system of claim 7, including a handle attached at said second end of said support member, wherein said handle extends from said first side to said second side.

9. The saddle hanging system of claim 6, wherein said tube is sized to receive a bar extending through said tube.

* * * * *